US007370827B2

(12) United States Patent
Ridgeway, Jr. et al.

(10) Patent No.: US 7,370,827 B2
(45) Date of Patent: May 13, 2008

(54) PACKAGING SPOOL AND PROCESS FOR PRODUCING SAME

(76) Inventors: Lawrence M. Ridgeway, Jr., 2412 Ben Hogan Cir., Florence, SC (US) 29506; James M. Lee, 3929 Breckenridge Cir., Florence, SC (US) 29506

( * ) Notice: Subject to any disclaimer, the term of this patent is extended or adjusted under 35 U.S.C. 154(b) by 1356 days.

(21) Appl. No.: 10/042,687

(22) Filed: Aug. 21, 2001

(65) Prior Publication Data

US 2005/0139722 A1 Jun. 30, 2005

(51) Int. Cl.
*B65H 75/14* (2006.01)

(52) U.S. Cl. ..... 242/608.8; 242/610.4; 242/610.6; 264/46.5; 264/46.9; 264/262

(58) Field of Classification Search ..... 264/261, 264/46.5, 46.6, 46.9, 262, 267; 242/608.8, 242/610.4, 610.6
See application file for complete search history.

(56) References Cited

U.S. PATENT DOCUMENTS 2,990,133 A * 6/1961 Tucker, Jr. ..... 242/118.7
3,179,245 A 4/1965 Bastian
3,271,498 A * 9/1966 Rohe et al. ..... 264/261
3,322,373 A 5/1967 Wilson et al.
3,454,235 A 7/1969 Hurley
3,460,246 A 8/1969 Hatton
3,491,171 A 1/1970 French
3,592,406 A 7/1971 Martin et al.
3,621,698 A 11/1971 Rocco et al.
4,186,162 A 1/1980 Daley
4,253,570 A * 3/1981 O'Connor et al. ..... 206/391
4,415,513 A 11/1983 Plachy
4,455,274 A 6/1984 Horney
5,229,048 A 7/1993 Nelson
5,535,961 A 7/1996 Duckworth et al.
5,660,900 A 8/1997 Andersen et al.
5,660,901 A 8/1997 Wong
5,721,031 A 2/1998 Echigo et al.

* cited by examiner

*Primary Examiner*—John Q. Nguyen
(74) *Attorney, Agent, or Firm*—R. Craig Killough

(57) ABSTRACT

A reel or spool package has opposing sidewalls or flanges formed of the specified or appropriate substrate and connected by a core formed of a flowable material which sets or cures to harden, such as a two part expandable polyurethane foam. The foam is applied into a partition, which may be a paper ring, by an injection and metering device. The chemistry of the flowable material may be altered to change density, rigidity and flexibility as required by package stresses. The polyurethane foam is an effective adhesive medium, thereby forming the core and connecting the sidewalls to form the package.

33 Claims, 2 Drawing Sheets

PACKAGING SPOOL AND PROCESS FOR PRODUCING SAME

FIELD OF THE INVENTION

This invention relates to packaging materials generally, and is more specifically related to reels or spools for packaging.

BACKGROUND OF THE INVENTION

Reel packages and spool packages are used for the packaging of products which are produced in a continuous and connected manner and are packaged in large number or high count continuous lengths for long run use, including automated use. These products are typically packaged in a "ribbon wound" (layer on layer) or convolute manner on a central core of a size closely matching the width of the manufactured product, so that the user of the product may unwind the product in an orderly, controlled manner for use or installation in other products. Products which are packaged on reels and spools are made of a wide variety of raw materials including metals, plastics, textiles and other products. The stiffness of some continuous products is such that the package must have a core with a large circumference (12 to 20") to prevent undesired curling or bending of the manufactured product. Additionally, packages for these products have sidewalls or flanges which act as retainers to keep the product from slipping off and becoming twisted, bent, damaged or difficult or impossible to use. The sidewalls for larger reels used for relatively rigid products range in size from 20" to 48", and are made of corrugated board, solid fibreboard, Masonite, plastic and plywood. While there are technical differences between spools and reels as these terms are used in the art, the term "reel" is used herein to indicate reels and spools used for packaging.

The cores of prior art reels are made of a number of substrates such as pre-formed and pre-cut styrofoam discs, or pressed wood, or plywood discs. Another embodiment employs rings of paper tubing cut from pre-made large diameter spiral or convolute paper tubes of a size or width which very nearly matches the width of the product being packaged. The sidewalls or flanges are then attached or fastened in a manner which protects the product from external damage, confines the product to minimal sidewise movement, and keeps the product wound in a single width convolute package, thereby allowing for orderly unwinding of the product by the user.

The methods employed in the prior art for joining sidewalls or flanges to cores are varied. Since some of the cores are discs with solid sides (such as styrofoam or pressed wood), adhesives are applied to these sides and the sidewalls of paper and corrugated board are brought into contact and unitized by the curing of the adhesive.

Other packages are of such large diameter that factors such as weight and cost make solid cores impractical. In such cases, cores are formed of paper rings of appropriate diameter and face width (matching the product to be wound) which are centered on sidewalls with holes punched to accept flat head threaded bolts of a length appropriate to the width of the product (with allowance for the thickness of the sidewall substrates). The bolt holes are positioned in close proximity to the rings, so that when they are tightened, they eliminate, or minimize, rotation of the ring. The second sidewall is positioned, and bolts are pressed through both sidewalls, and capped head or "T" nuts are attached to the bolts and tightened, creating a circular package or reel customized to the products width and load area. The load area is the area from the ring or core to the outside diameter of the flange or sidewall is the load area.

The sidewalls or flanges often have punches or apertures for different functions positioned on its face such as:

1. A center or arbor hole for mounting on an axis or rod for smooth "take up" or "let off" of the continuous product.
2. A drive hole to accept a pin which will, when a rotational force is applied, turn the package and thereby wind or "take up" the product as it is produced. (This arbor and drive hole configuration has become largely standardized and has a fixed central location)
3. Small apertures for inspection, product access and handling, which have no meaningful structural significance.

SUMMARY OF THE INVENTION

The present invention is an improvement of reel or spool packages. The package of the present invention comprises opposing sidewalls or flanges formed of the specified or appropriate substrate which are connected by a core. The core is formed by a partition which acts as a mold, such as a simplified paper ring, filled with a flowable material which hardens. The flowable material may be a two part expandable polyurethane foam which is applied into the partition by a metering and injection device. The chemistry of the foam formulation may be altered to change density, rigidity and flexibility as required by package stresses. The foam is a very aggressive and effective adhesive medium, which forms the core while connecting the sidewalls to form the package.

DESCRIPTION OF THE PREFERRED EMBODIMENTS

Figure 1:
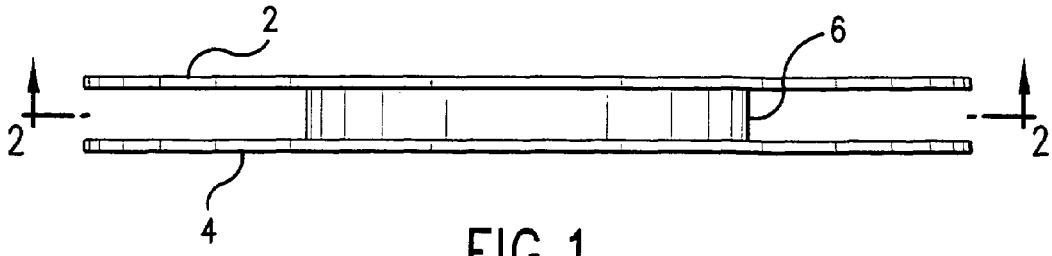
FIG. 1 is a top, plan view of a reel used for packaging.
Figure 2:
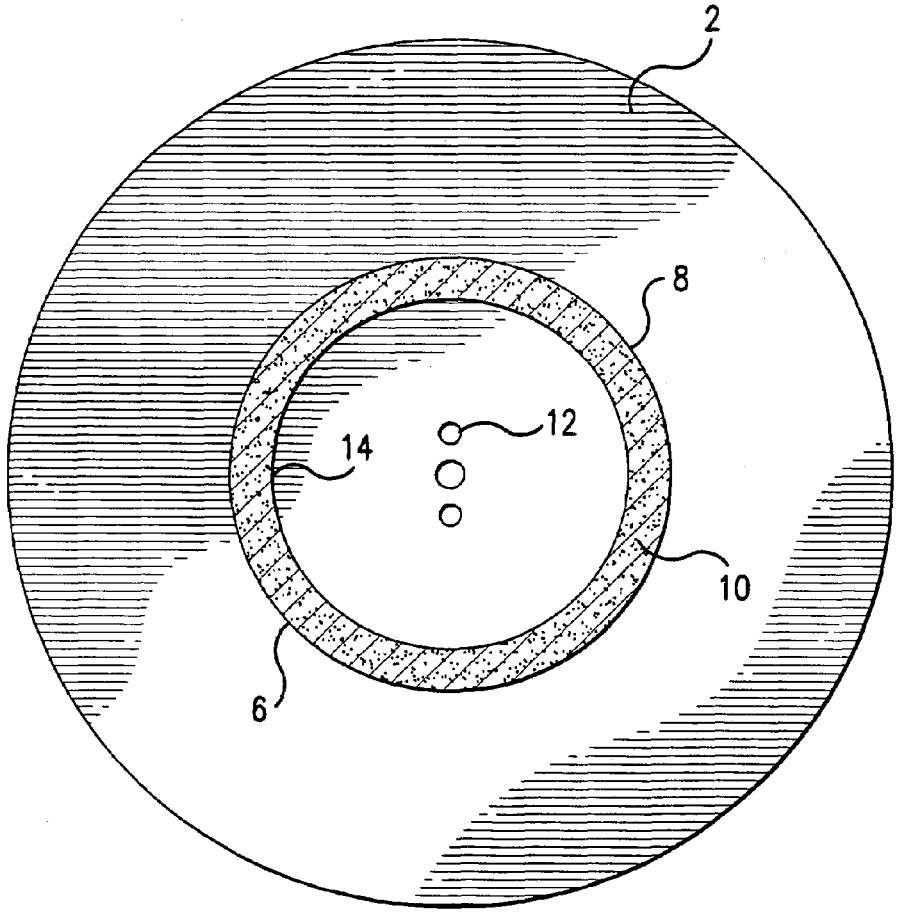
FIG. 2 is a sectioned view of a reel for packaging.
Figure 3:
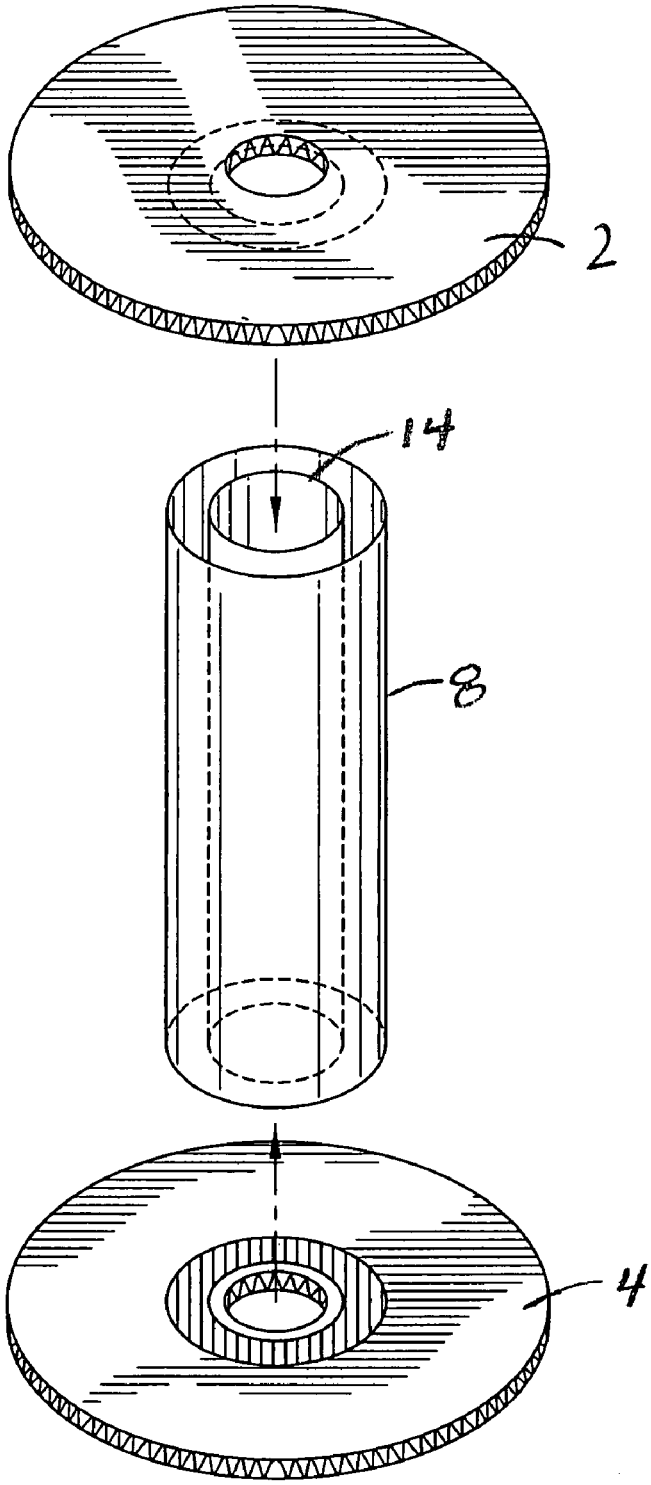
FIG. 3 is an exploded view of a reel for packaging having corrugated side walls.

The reel package of the present invention comprises opposing sidewalls 2,4 or flanges formed of the specified or appropriate substrate. The sidewalls 2,4 or flanges maybe formed of paper, styrofoam, wood or other suitable material. FIG. 1. The sidewalls 2,4 or flanges may be formed of corrugated material, including corrugated paper. FIG. 3. The sidewalls are connected by a core 6 formed of polyurethane. The core is formed or molded by preparing a partition, which may be a ring 8. The ring may be made of paper or other suitable material, which is filled with a flowable material 10, and acts as a mold, and forms the flowable material.

The flowable material is a liquid or semi-liquid material, which will harden or set to form a core. The flowable material also acts as adhesive to connect the sidewalls to the core.

The flowable material is preferred to be comprised of two-part expandable polyurethane foam. Polyurethanes are formed by isocyanates, which are reacted with agents having a hydroxyl group, such as polyols. These materials may be produced as foam which expands as it is dispensed. The foam is delivered into a defined void in a metered dosage. The foam fills the void, and the reaction of the components causes the foam to set and become solid in the shape of the void. The chemistry of the foam formulation may be altered to change density, rigidity and flexibility as required by package stresses. The expanded foam is a very aggressive and effective adhesive medium. As the foam cures it adheres to each of the sidewalls, it performs the dual function of forming the core and connecting the sidewalls to form the completed reel, and no mechanical fasteners are required.

A partition accepts the foam therein and molds the foam to form the core. The preferred material for the partition is a ring formed of paper. A paper ring is easily and inexpensively formed. The foam is applied into the paper ring by an injection device, which meters the foam to be injected. Upon injection into paper ring, the wet foam bonds to the sidewalls. The foam reacts and hardens to form the core after an exothermic reaction of short duration. Normally, it is unnecessary to remove the paper ring after the foam sets.

A simple frame, sized to handle multiple sidewall diameters, fitted with mechanically retractable dowels centrally positioned to form the arbor holes and drive holes may be used as an assembly fixture for the package. Two sidewalls, prepared with appropriate apertures, including any required arbor or drive holes 12, are sized to slip over the dowels. Sidewall 2 is positioned in the assembly fixture over the retractable dowels. A paper ring 6 of appropriate width and diameter is positioned and mechanically centered on the sidewall by position guides. A controlled amount of the specially formulated two part expandable polyurethane foam is injected into to the void 10 created by the outer (paper ring) and the center dowel. The second or top sidewall 4 is put in place as the foam begins to expand and fill the void, which becomes a closed compartment created by the positioning of the second sidewall or flange. The dowels form a continuous void through the reel as the foam sets. The continuous void is present in the sidewalls and the core.

The foam expands to the limits of the compartment or void formed by the paper ring. In the process, the foam bonds all of the substrates or components into a single, rigid, lightweight package of a size and strength required for the application. The dowels are retracted leaving the arbor and drive holes clear and in proper position.

For reels or packages which require large diameter cores and wide separation of the sidewalls or flanges, the amount of foam used can be reduced by a second ring 14 of a smaller diameter, but which matches the width or face dimension of the outer ring. The second ring is usually placed concentrically with the first ring. A compartment is formed between the top and bottom sidewalls and the two rings into which the foam is dispensed. Chemical variation of the density of the foam mix allows the strength characteristics to be adjusted to compensate for the reduced area of adhesion. The use of two rings to create a compartment reduces the amount of polyurethane used to fill a void and create a bond. Other shaped materials are also effective in partitioning a void, or occupying space in the void, to achieve the similar results.

For reels with relatively small cores only a single paper ring of appropriate diameter will normally be used. An assembly fixture with the commercially available foam injection device assists in assembly and bonding. For maximum size capability, a yoke positioned between the sidewall flanges and configured (or vacuum fitted) to position a heavy gauge paper strip in a circle around the center at the appropriate size position is sufficient to act as a barrier to the foaming agent, and effectively create the core of the proper size.

Spools and the large diameter reels mentioned earlier are of the same family of circular packaging. The invention works well with reel packages having diameters of 20 inches to 48 inches, and is particularly cost effective with regard to such relatively large spools. Other applications of the process of the invention lend themselves to the dramatic cost savings in eliminating components and complexity of assembly. For example, plywood sided reels or spools which currently use the "Bolt-Thru" method of assembly may be formed by the method herein. The formulations achievable with the foam and the light wallpaper tubes to compartmentalize the application are very effective low cost replacements for the cores and assembly processes of the prior art, without changing the plywood used as the sidewall medium. The bond strength and variable density features are ideal for many heavy-duty applications.

Retail ribbon spools are another area of potential application. The stress requirements are very low and the paper tubes currently used as the core material represent a major portion of the components cost. The replacement of the tube with a simple paper barrier compartment and foam bonding is simpler and less expensive.

Since the polyurethane foam is a highly effective bonding agent, plastic spools which require solvent bonding and complex tooling to impart strength and gain dimensional integrity are unnecessary. The use of simplified flanges bonded to a high strength core according to the present invention is an effective replacement. The elimination of harmful solvents is considered a benefit to the safety of the work place. The urethane foam is a safe bonding agent, and has an enviable record in industrial applications.

What is claimed is:

1. A reel around which a product is wound for transportation and storage, comprising:

a first sidewall;

a second sidewall;

a partition located between said first sidewall and said second sidewall, with one end of said partition being positioned adjacent to said first sidewall, and an opposite end of said partition being positioned adjacent to said second sidewall, said partition having an interior void which is filled with a flowable material, wherein said flowable material sets within said partition to form a solid core, and said flowable material sets and adheres to said first sidewall and to said second sidewall and connects said first sidewall to said second sidewall, wherein an entire perimeter of said first sidewall extends beyond an outside perimeter of said solid core, wherein said first sidewall and said second sidewall are formed of a material other than said flowable material.

2. A reel around which a product is wound for transportation and storage as described in claim 1, wherein a continuous void is formed which extends through said first sidewall, said core and said second sidewall.

3. A reel around which a product is wound for transportation and storage as described in claim 2, wherein said first sidewall is generally circular and is generally concentric with said partition, wherein said outside perimeter of said partition is generally circular.

4. A reel around which a product is wound for transportation and storage as described in claim 3, wherein said flowable material is polyurethane foam.

5. A reel around which a product is wound for transportation and storage as described in claim 2, wherein said flowable material is polyurethane foam.

6. A reel around which a product is wound for transportation and storage as described in claim 1, wherein said first sidewall is generally circular and is generally concentric with said partition, wherein said outside perimeter of said partition is generally circular.

7. A reel around which a product is wound for transportation and storage as described in claim 6, wherein said first sidewall is formed of paper.

8. A reel around which a product is wound for transportation and storage as described in claim 7, wherein said first sidewall is formed of corrugated paper.

9. A reel around which a product is wound for transportation and storage as described in claim 7, wherein said flowable material is polyurethane foam.

10. A reel around which a product is wound for transportation and storage as described in claim 6, wherein said flowable material is polyurethane foam.

11. A reel around which a product is wound for transportation and storage as described in claim 1, wherein said partition is formed of paper.

12. A reel around which a product is wound for transportation and storage as described in claim 11, wherein said first sidewall is formed of corrugated paper.

13. A reel around which a product is wound for transportation and storage as described in claim 11, wherein said flowable material is polyurethane foam.

14. A reel around which a product is wound for transportation and storage as described in claim 1, wherein said first sidewall is formed of corrugated material.

15. A reel around which a product is wound for transportation and storage as described in claim 14, wherein said flowable material is polyurethane foam.

16. A reel around which a product is wound for transportation and storage as described in claim 1, wherein said first sidewall is formed of wood.

17. A reel around which a product is wound for transportation and storage as described in claim 1, wherein said first sidewall is formed of Styrofoam.

18. A reel around which a product is wound for transportation and storage as described in claim 1, wherein said flowable material is polyurethane foam.

19. A reel around which a product is wound for transportation and storage as described in claim 1, wherein said partition is formed of an outer ring and an inner ring, and wherein said void which is filled with said flowable material is present between said outer ring and said inner ring.

20. A reel around which a product is wound for transportation and storage, comprising:

a first sidewall;

a second sidewall;

a partition located between said first sidewall and said second sidewall, with one end of said partition being positioned adjacent to said first sidewall, and an opposite end of said partition being positioned adjacent to said second sidewall, said partition having an interior void into which a flowable and expandable material is placed, wherein said flowable and expandable material expands and sets within said partition to fill said interior void and form a solid core, and said flowable and expandable material sets and adheres to said first sidewall and to said second sidewall and connects said first sidewall to said second sidewall, wherein an entire perimeter of said first sidewall extends beyond an outside perimeter of said solid core, wherein said first sidewall and said second sidewall are formed of a material other than said flowable and expandable material.

21. A reel around which a product is wound for transportation and storage as described in claim 20, wherein said flowable and expandable material comprises a polyol and an isocyanate.

22. A reel around which a product is wound for transportation and storage as described in claim 20, wherein said partition is formed of an outer ring and an inner ring, and wherein said interior void is present between said outer ring and said inner ring.

23. A reel around which a product is wound for transportation and storage as described in claim 20, wherein a continuous void is formed which extends through said first sidewall, said core and said second sidewall.

24. A reel around which a product is wound for transportation and storage as described in claim 23, wherein said first sidewall is generally circular and is generally concentric with said partition, wherein said outside perimeter of said partition is generally circular.

25. A reel around which a product is wound for transportation and storage as described in claim 20, wherein said first sidewall is generally circular and is generally concentric with said partition, wherein said outside perimeter of said partition is generally circular.

26. A reel around which a product is wound for transportation and storage as described in claim 20, wherein said partition is formed of paper.

27. A reel around which a product is wound for transportation and storage as described in claim 20, wherein said first sidewall comprises paper.

28. A reel around which a product is wound for transportation and storage as described in claim 20, wherein said first sidewall comprises plastic.

29. A reel around which a product is wound for transportation and storage as described in claim 20, wherein said first sidewall comprises wood.

30. A reel around which a product is wound for transportation and storage as described in claim 20, wherein said first sidewall is formed of corrugated paper.

31. A reel around which a product is wound for transportation and storage as described in claim 20, wherein said first sidewall is formed of wood.

32. A reel around which a product is wound for transportation and storage as described in claim 20, wherein said flowable and expandable material comprises an expandable foam.

33. A reel around which a product is wound for transportation and storage as described in claim 20, wherein said flowable and expandable material comprises polyurethane foam.

* * * * *